United States Patent [19]

Dufrene

[11] 3,960,399

[45] June 1, 1976

[54] SETTING AND RETRIEVAL DEVICE FOR DOWN-HOLE EQUIPMENT

[76] Inventor: Alex Dufrene, P.O. Box 194, Des Allemands, La. 70030

[22] Filed: Dec. 16, 1974

[21] Appl. No.: 532,996

[52] U.S. Cl. ..... 294/86.25; 294/86.18; 294/86.2

[51] Int. Cl.[2] ..... E21B 31/02

[58] Field of Search ..... 294/86.1, 86.12, 86.14, 294/86.17–86.33, 94, 96; 166/99, 136, 137, 214, 215

[56] References Cited

UNITED STATES PATENTS

| | | | |
|---|---|---|---|
| 1,358,807 | 11/1920 | Wilkinson | 294/86.22 |
| 1,445,680 | 2/1923 | Guess | 294/86.25 X |
| 1,573,646 | 2/1926 | Schiefferle et al. | 294/86.28 |
| 1,715,481 | 6/1929 | Ventresca | 294/86.22 |
| 3,108,637 | 10/1963 | Lee et al. | 294/86.25 X |
| 3,527,494 | 9/1970 | Young | 294/86.25 |

*Primary Examiner*—John J. Love
*Assistant Examiner*—Johnny D. Cherry

[57] ABSTRACT

A setting and retrieval device for down-hole equipment which includes a solid mandrel tapered at its bottom to a larger diameter which cooperates with a set of surrounding collet fingers which have a shoulder and gripping threads thereon to engage a fish or a tool to be set down hole. The apparatus is used as a running tool and a retrieval tool. The collet fingers slide relative to the taper at the urging of a compressible spring arranged between a slidable thimble which supports the collet fingers. It is locked in the up position by serrations which face one another.

9 Claims, 2 Drawing Figures

SETTING AND RETRIEVAL DEVICE FOR DOWN-HOLE EQUIPMENT

RELATED APPLICATIONS

This application is directed to a tool for running and retrieving of down-hole equipment such as a pack-off device which is disclosed in co-pending patent application Ser. No. 532,997 entitled "Well Pack-Off Apparatus," filed of even date herewith.

BACKGROUND OF THE INVENTION

In setting and retrieving tools of the sort shown in the co-pending application, various tools have been provided. The retrieval tools often differ from the setting tools. This invention is directed to a tool which serves both purposes. It is uniquely qualified to set the pack-off device of the co-pending application, or any other apparatus which functions in like manner. It is likewise adapted to retrieve the pack-off device. It achieves this by reversing the sequence of operation so that the same tool can be used for installation and retrieval.

SUMMARY OF THE INVENTION

The present invention incorporates a solid body having a threaded connection at the upper end to engage a mechanical or hydraulically operated jar. The device includes a solid upper body which has a central drilled axial opening. A solid mandrel is threaded into the axial opening. The mandrel extends downwardly to the lower end and has a flared or tapered lower end. The angle of taper is relatively small, typically in the range of up to 12°. The tapered lower end is a solid plug which expands a set of collet fingers which are slidably mounted for movement along the taper. When the collet fingers move to the lower end of the tapered mandrel, they are flared outwardly. When they move upwardly, they are free to flex inwardly to be reduced in diameter and release a tool or fish. The collet fingers are supported on a circular thimble. It connects to an upper skirt which surrounds the solid mandrel. The skirt has downwardly facing serrations. A second and surrounding cylindrical skirt has upwardly facing serrations. The two skirts relatively slide in and define a tubular volume adapted to receive a compressed coil spring which forces the bottom skirt downwardly. The spring is compressible to force the bottom skirt and the collet fingers downwardly toward the position at which they flare outwardly. The lower skirt, the thimble and collet fingers slide upwardly and downwardly to move from a relaxed and small diameter position to a large diameter position, thereby enabling a pack-off or other tool to be set or retrieved in a well.

DESCRIPTION OF THE PREFERRED EMBODIMENT

Figure 1:
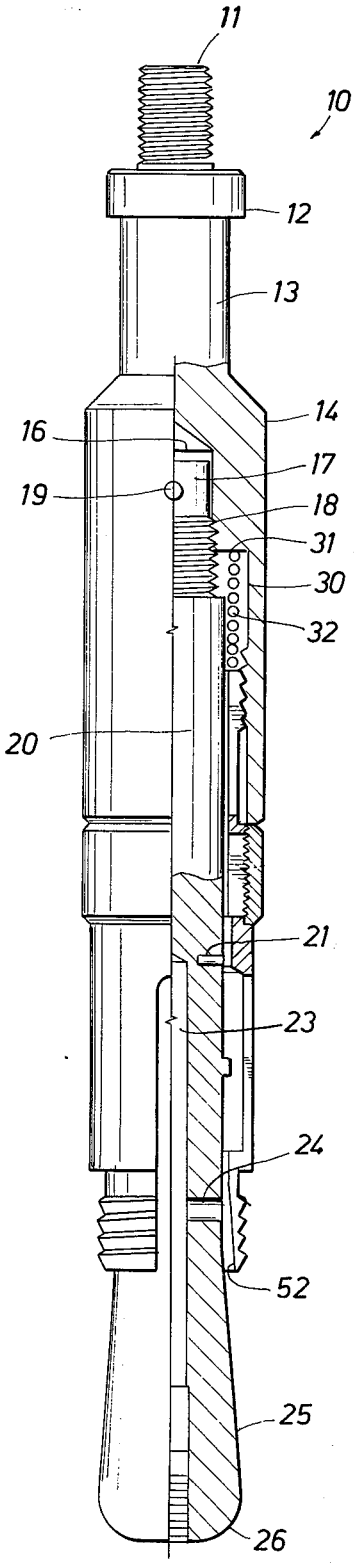
FIG. 1 is a sectional view through the running and retrieval tool of the present invention showing details of construction, with the collet fingers in the up position; and, FIG. 2 is a view similar to FIG. 1 showing the collet fingers in the down and expanded position, at the urging of the elongate coil spring which has been extended.

In FIG. 1, the tool 10 is illustrated. It functions as both a setting and a retrieval tool. The tool 10 includes a threaded upper end 11 which is adapted to be threadedly engaged to a jar of appropriate construction or a swivel or some other form of connector. A shoulder 12 limits the threaded engagement of the connective equipment. The shoulder 12 overhangs a narrow neck 13 to define a fishing shoulder in accordance with API standards. The neck 13 connects to a solid body 14 which flares to a greater diameter. The body 14 is countersunk with an axial bore 16. The body 14 is concentric about the opening 16. A solid mandrel 17 is threaded into the opening 16 and a threaded connection is made at 18 to join the two together. The body 14 is shorter than the solid mandrel 17. The mandrel 17 is substantially long and is of solid construction except for some small holes drilled therein.

A small hole 19 is drilled through the body 14 and the mandrel 17 to define a position for a lock pin which joins the two together, preventing unthreading of the joint 18. The mandrel 17 has a central tubular portion 20 which is of solid construction. The mandrel is drilled with a lateral passage 21 to enable a shear pin to be placed in it. The shear pin 22 is optional, and its use is not required. The solid mandrel is axially drilled at 23. It has an axial passage extending from the lower end toward the upper end. It terminates about half-way through the device. The passage provides a fluid flow route into the tool. This is particularly helpful in avoiding the build-up of pressure from down-hole flow. As the tool is run into a well bore, fluid can flow upwardly through the passage 23 and escapes through a lateral passage 24. The passage 24 is located at some point upstream of the lower end of the passage 23. This provides a pressure release route.

The mandrel 17 includes an enlarged tapered portion 25 at its lower end. The tapered surface 25 flares outwardly at a slight angle, perhaps as much as 12°, but not more than this preferably. It is not necessary to taper at a more severe angle. The lower end of the mandrel 17 is rounded at 26 to define a smooth, easily manipulated surface which has no square corners to snag or hang on other equipment.

Figure 2:
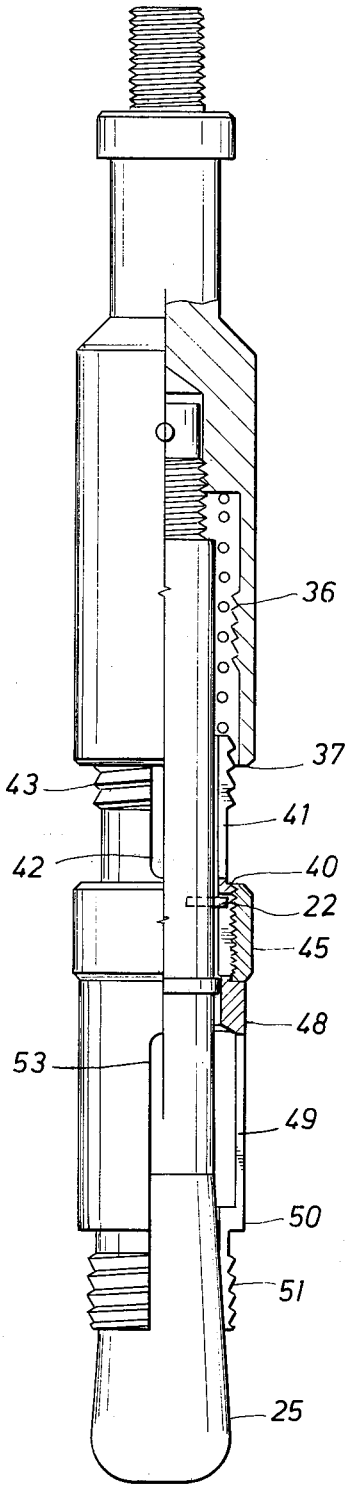

The upper body 14 is drilled with the axial tapped passage 16, and includes an appended upper skirt 30. The skirt 30 is spaced outwardly from the upper portion 20 of the mandrel. This defines a tubular cavity in the tool. The skirt 30 terminates at a shoulder 31. The shoulder 31 supports and receives a coil spring 32. The spring is captured on the interior of the skirt 30. The skirt 30 is provided with an upwardly facing set of serrations 36 shown separate in FIG. 2. The serrations 36 preferably comprise a set of threads which have shoulders facing upwardly. They lock with a set of serrations to be described.

The skirt 30 terminates at a lower shoulder 37 which locks upward movement of cooperative equipment. The cooperative equipment includes a ring 40 which is loosely fitted about the mandrel 17. The ring 40 carries a number of collet fingers 41 which extend upwardly. They define a smaller skirt except that they are cut with lengthwise slots 42 which define the various collet fingers. They are provided with external threads 43 which are cut as downwardly facing serrations. The serrations 43 match the serrations 36 and the two sets are adapted to lock together when the lower skirt or ring 40 is moved upwardly. Upward movement jams the serrations together. The collet fingers 41 flex inwardly enabling greater penetration of the smaller collet fingers into the large diameter opening on the inside of the skirt 30, moving the two to a locked positions where the serrations lock with one another. They lock together on axial movement. They are unlocked by threaded disengagement. The threaded disengagement is readily achieved by hand upon retrieval of the tool as will be described. Locking together of the serrations is achieved against the force of the spring 32 which forces the lower skirt dowwnwardly.

The ring 40 is threaded on its outer surface and connects with a large nut 45. The nut 45 encircles the transverse opening 21 to enable a shear pin to be positioned therein. The nut is sufficiently large to move axially of the mandrel 17, clearing the shear pin.

The nut 45 threads to the ring 40 and also joins to a lower sleeve 48. The sleeve 48 surrounds the mandrel and slides on it. The sleeve 48 supports a number of collet fingers 49 which have an integrally formed downwardly facing shoulder 50 and a set of serrations 51. The collet fingers have a slight flare at the bottom as shown at 52 in FIG. 1. This enables them to smoothly slide on the tapered mandrel 17 and flare outwardly as they move along it. As the collet fingers move up and down along the mandrel 17, they are flared outwardly as appropriate. The serrations 51 enable the collet fingers to grasp a fish or other item of interest.

The collet finges are defined by adjacent longitudinal slots 53 cut in the lower skirt 48. Typically four or six collet fingers are adequate. They are relatively thin walled to enable them to flex outwardly. They are made of a metal which is sufficiently resilient to flex outwardly and move inwardly after flexure. The collet fingers are appended to the skirt 48 which moves as a unit in conjunction with the nut 45 and the ring 40. The upper set of collet fingers 41 move with the slidably mounted equipment. The slidably mounted assembly provides the motion for the device to provide locking or retrieval of the tool 10 with a fish or other tool.

The device is used in the following manner. To operate the tool as a pulling tool, it is run down-hole on a jar on a wireline. It is run with the collet fingers 49 in the down position or in the position of FIG. 2. The tapered mandrel portion 26 is run into the fish and the fish is engaged by the collet fingers which flex inwardly enabling the fish to be engaged and snugged against the shoulder 50. After this has been accomplished, the flexure of the collet fingers outwardly holds the fish and enables its retrieval. If the fish does not yield to an upward pull, the operator jars down on the tool, which causes the upper skirt comprised of the collet fingers 41 to move upwardly against the spring because of inertial upset. This inertial movement shears the pin and forces the serrations 36 and 43 together, thereby locking the collet fingers 49 in the up position. This locks the collet fingers opposite a portion of the solid mandrel, which has a relatively narrow diameter, and enables them to flex inwardly on an upward pull on the wireline to retrieve the tool 10. This pulls the tool free of the fish if the fish is badly stuck. At this juncture the tool can be retrieved without the fish. Setting the tool from the position of FIG. 1 to the position of FIG. 2 requires only four or five revolutions to unthread the serrations 43 from the serrations 36.

As a running tool, the shouler 51 is jammed into a tool to be set, such as the pack-off of the co-pending disclosure. The shoulder 50 limits the penetration of the tool into the pack-off or the other device. The collet fingers 49 are forced downwardly on the taper and flare outwardly, thereby locking the tool to be set to the running tool 10. This is accomplished with the serrations 36 and 43 in the position of FIG. 2. The tool to be set and the running tool 10 are run into the drill string. Downward jarring on the apparatus forces the solid mandrel relatively downwardly while the shoulder 50 forces the slidable assembly upwardly. As it slides upwardly, it moves to a portion of the mandrel which is not tapered, and hence of smaller diameter, thereby enabling the collet fingers 49 to flex inwardly. On jarring, the serrations 43 are forced into the serrations 36 and thereby lock the slidable assembly in the up position. This then enables disconnection of the running tool from the tool which is to be left in the well. The jarring on the tool jams and locks the serrations together for retrieval of the tool. Optionally, the shear pin can be placed in the opening 21 to require a minimum of jarring impact from the oil jar tool which must shear the pin prior to locking. This avoids accidental locking of the tool.

The apparatus serves as four tools, a running tool, a pulling tool, and both with or without a shear pin. The shear pin makes operation more difficult, which in many instances is very desirable. The added force which is required to shear the pin can be controlled and observed by the operator at the well head, and makes its operation more desirable.

It is uniquely qualified for use with the apparatus in the related application. Other uses and applications of the tool appear in operation.

The foregoing is directed to the preferred embodiment. The scope is determined by the claims which follow.

I claim:

1. A wire line supported running tool for down-hole equipment manipulation, comprising:

an elongate tapered mandrel;

a set of collet fingers encircling said mandrel, said fingers flexing radially inwardly and outwardly dependent on their relative position adjacent to said tapered mandrel;

incorporating an exposed seating surface for grasping collectively and releasing a tool to be manipulated in a well;

and collectively mounted on and movable with a slidable collar about said mandrel to positions along said mandrel where the taper thereof deflects them to grasp and release a tool;

a first cylindrical member relatively fixed to said mandrel;

a second cylindrical member relatively fixed to said collet fingers and slidably positioned relatively to said first member; and, jar operated means cooperative with said first and second cylindrical members which selectively maintains said first and second cylindrical members axially at a fixed relationship to grasp or release a tool.

2. The apparatus of claim 1 wherein said last named means incorporates:

a set of serrations on one of said members;

a second set of serrations on the other of said members facing the first set, and mating therewith on axial movement into engagement for temporarily holding said serrations; and, a resilient means which flexes and biases said serrations in specified directions.

3. The apparatus of claim 2 wherein one set of serrations is formed on a set of flexible fingers longitudinally cut and parallel to one another and which comprise one of said cylindrical members.

4. The apparatus of claim 3 wherein said collet fingers are threadedly connected to an encircling nut assembly which supports said slidable collar for axial movement as a unit.

5. The apparatus of claim 4 including a shear pin which is positioned by said tapered mandrel to limit movement of said slidable collar relative to said mandrel until said shear pin is sheared.

6. The apparatus of claim 5 including a compressed spring which urges said collet fingers toward a specified end of said mandrel and which spring force is overcome on movement of said collet fingers to a longitudinally shifted position along said mandrel.

7. The apparatus of claim 6 wherein said spring is received into a cylindrical chamber exterior of said mandrel and interiorally of one of said cylindrical members which chamber is sized to encompass all of said spring.

8. The apparatus of claim 7 wherein said serrations thread and unthread with each other, and said spring biases them apart.

9. The apparatus of claim 8 wherein one set of serrations is formed on the exterior of said collet fingers which comprise one of said cylindrical members and the other set of serrations is on the interior of said first cylindrical member.

* * * * *